US008087409B2

(12) United States Patent
Kung

(10) Patent No.: US 8,087,409 B2
(45) Date of Patent: Jan. 3, 2012

(54) HEATER FOR FOOTWEAR

(76) Inventor: Chun-Yen Kung, Taichung (TW)

( * ) Notice: Subject to any disclaimer, the term of this patent is extended or adjusted under 35 U.S.C. 154(b) by 368 days.

(21) Appl. No.: 12/365,871

(22) Filed: Feb. 4, 2009

(65) Prior Publication Data

US 2010/0193497 A1 Aug. 5, 2010

(51) Int. Cl.

| | |
|---|---|
| ***A43C 19/00*** | (2006.01) |
| *A43B 13/18* | (2006.01) |
| *A43B 7/02* | (2006.01) |
| *F24J 3/00* | (2006.01) |

(52) U.S. Cl. ..... 126/204; 126/247; 36/2.6

(58) Field of Classification Search ..... 126/204, 126/247; 36/2.6; *A43C 19/00; A43B 13/18, A43B 7/02*

See application file for complete search history.

(56) References Cited

U.S. PATENT DOCUMENTS

| | | | | | |
|---|---|---|---|---|---|
| 248,625 | A | * | 10/1881 | Wells | 122/26 |
| 683,747 | A | * | 10/1901 | Gotsche | 126/247 |
| 1,272,931 | A | * | 7/1918 | Etheridge | 36/2.6 |
| 2,442,026 | A | * | 5/1948 | Thompson, Jr. | 36/2.6 |
| 2,552,711 | A | * | 5/1951 | Dunker | 36/3 R |
| 4,312,322 | A | * | 1/1982 | Freihage | 126/247 |
| 4,736,530 | A | * | 4/1988 | Lakic et al. | 36/2.6 |
| 4,756,095 | A | * | 7/1988 | Lakic | 36/2.6 |
| 5,056,502 | A | * | 10/1991 | Eyzaguirre et al. | 126/247 |
| 5,495,682 | A | * | 3/1996 | Chen | 36/2.6 |
| 2010/0236093 | A1 | * | 9/2010 | Kim | 36/27 |

FOREIGN PATENT DOCUMENTS

| | | | | |
|---|---|---|---|---|
| DE | 3106341 | A1 | * | 12/1982 |
| JP | 62055471 | A | * | 3/1987 |
| WO | WO 2008108596 | A1 | * | 9/2008 |

* cited by examiner

*Primary Examiner* — Steven B McAllister
*Assistant Examiner* — Daniel E Namay

(57) ABSTRACT

A heater for footwear includes a seat having a space centrally defined therein. A spring is compressively received in the space in the seat. A friction mechanism is received in the seat. A cap is sleeved on the seat. The cap has a driving unit longitudinally extending therefrom. The driving unit extends through the friction mechanism for movably abutting against the spring in the space in the seat. When the cap is pressed/released, the driving is unit moved relative to the seat for engaging the friction mechanism to warm up the footwear.

8 Claims, 6 Drawing Sheets

HEATER FOR FOOTWEAR

BACKGROUND OF THE INVENTION

1. Field of the Invention

The present invention relates to a heater, and more particularly to a heater for footwear.

2. Description of Related Art

A conventional heater for footwear includes shoes and boots in which an insole is provided with a heater element having leads extending therefrom to either the tongue area or a side area opposed to the arch of the shoe. A power source in the form of a battery pack is adapted to be mounted either in the tongue area or the side area by means of an enclasping means affixed externally of the battery pack.

However, the battery of the conventional heater is necessary for providing power source. It is inconvenient that the battery usually is needed to be recharged. Even worst, the battery is well known that causes pollution for the environment. It can not usefully use a green energy, especially the energy produced from human naturally walking. Furthermore, the conventional heater uses an electric system for providing a heating effect. It is hard to be assembled and costs more money.

The present invention has arisen to mitigate and/or obviate the disadvantages of the conventional heater.

SUMMARY OF THE INVENTION

The main objective of the present invention is to provide an improved heater for footwear.

To achieve the objective, the heater for footwear in accordance with the present invention comprises a seat having a space centrally defined therein. A spring is compressively received in the space in the seat. A friction mechanism is received in the seat. The friction mechanism includes a disk fixed in the seat, an upper rotor rotatably mounted on a top of the disk, and a lower rotor rotatably mounted on a bottom of the disk. A cap is sleeved on the seat. The cap has a driving unit longitudinally extending therefrom. The driving unit extends through the upper rotor, the disk, and the lower rotor for movably abutting against the spring in the space in the seat.

A power source of the heater for footwear in accordance with the present invention is a weight of a human when the human is walking. When a user walks and the cap is pressed/released by the weight of user, the driving unit is downwardly/upwardly moved relative to the seat for engaging the upper rotor and the lower rotor rotated relative to the disk. Heat is created by friction due to the upper rotor and the lower rotor respectively continuously rubbed the disk for warming up the footwear. There is no need for an external power source such as batteries. The heater in accordance with the present invention depends on a simply mechanical movement during human walking without any electric system. Therefore, the heater in accordance with the present invention has a lower cost than the conventional heater, and does not cause any pollution for environment.

A second embodiment of the heater in accordance with the present invention comprises a seat having a space defined therein. The seat has multiple position holes respectively defined in corners of a top thereof and communicating with the space. A friction mechanism is received in the seat. The friction mechanism includes an internal gear having teeth formed on an inner periphery thereof, a pad abutted against the internal gear, a pinion connected to the pad, an external gear partially received in the internal gear, a spring is mounted on the external gear. A cap is mounted on the seat, the cap having multiple shanks respectively extending from a bottom thereof for corresponding to the multiple position hole in the seat. Each shank has a spring mounted thereon to provide a bounce effect for the cap. The cap has a driving unit extending from the bottom thereof and engaged with the external gear.

When the cap is pressed/released, the driving unit is downwardly/upwardly moved relative to the seat. The driving unit engaged with the external gear engaged with the internal gear to rotate internal gear relative to the pad. Heat is created by friction due to the external gear continuously rubbed the pad for warming up the footwear.

Further benefits and advantages of the present invention will become apparent after a careful reading of the detailed description with appropriate reference to the accompanying drawings.

DETAILED DESCRIPTION OF THE INVENTION

Figure 1:
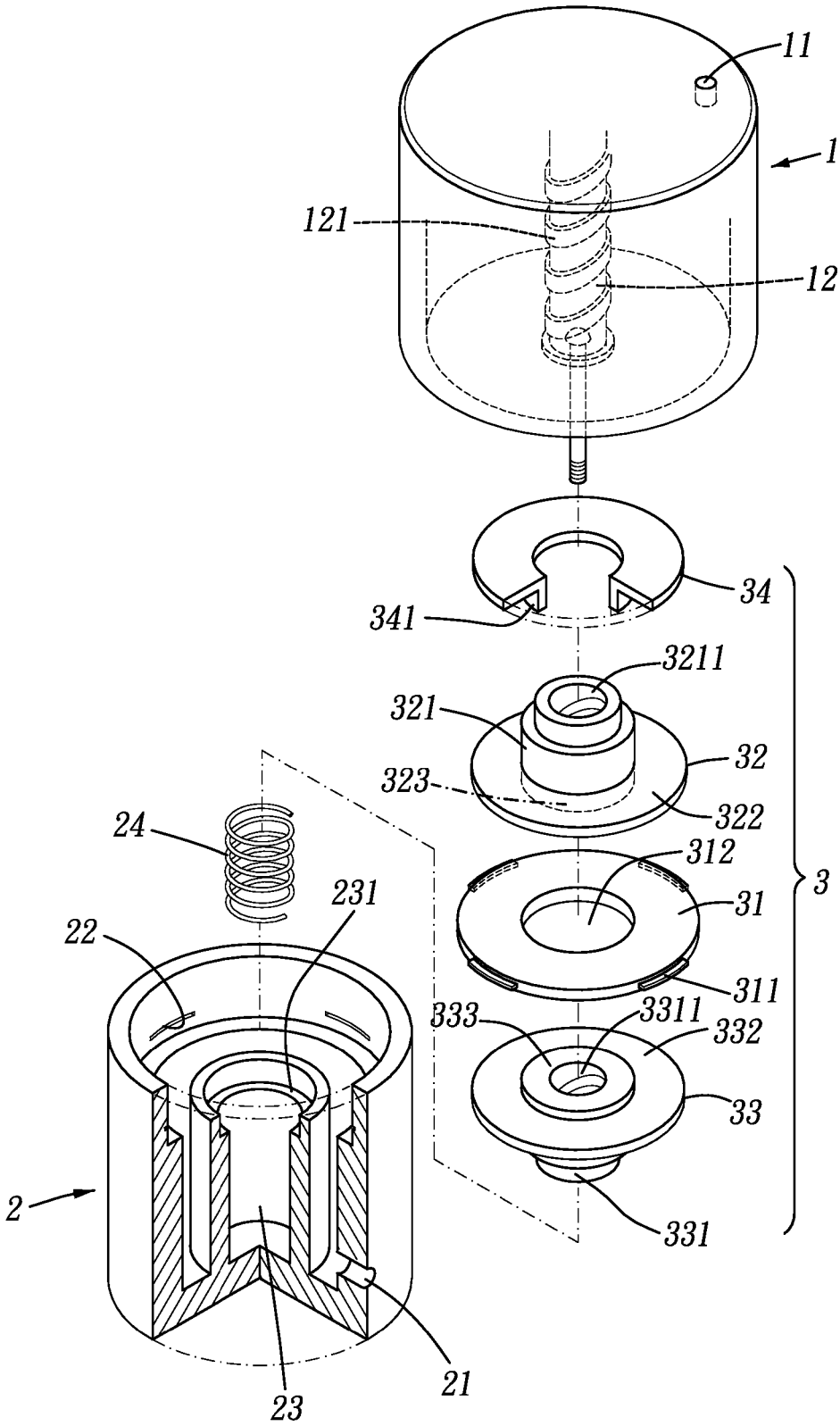
FIG. 1 is an exploded perspective view of a heater for footwear in accordance with the present invention.
Figure 2:
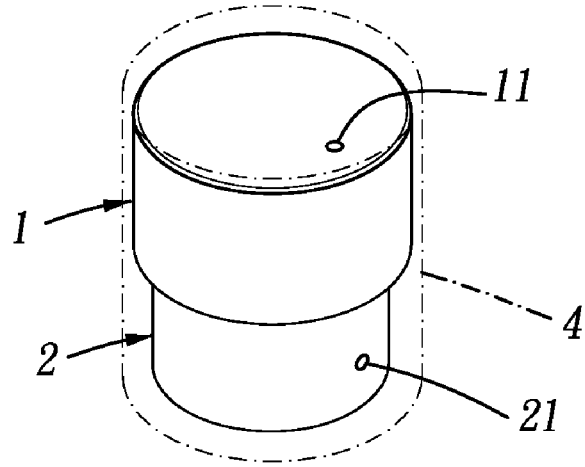
FIG. 2 is a perspective view of the heater for footwear in accordance with the present invention.
Figure 3:
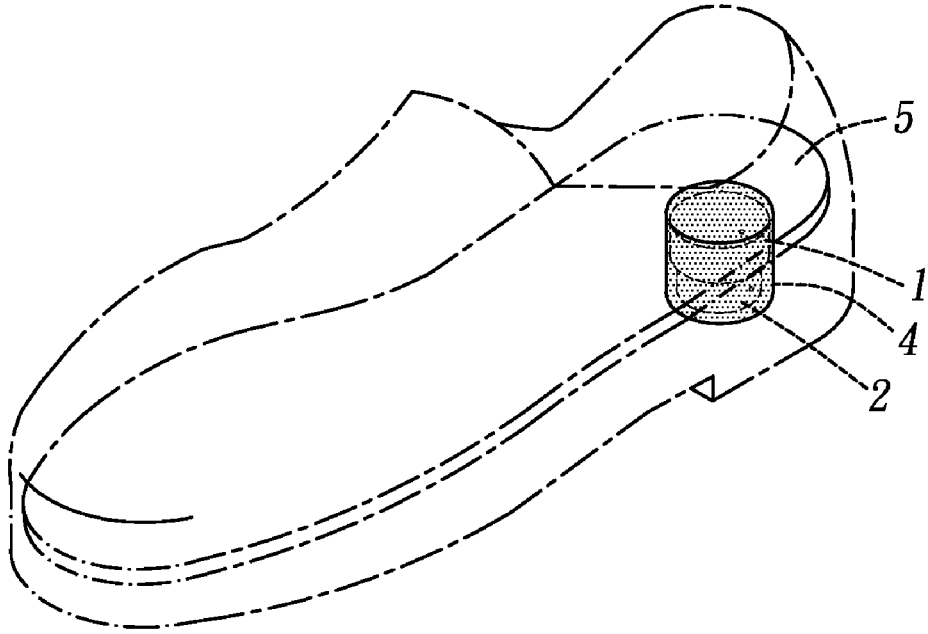
FIG. 3 is a schematic view of the heater in accordance with the present invention assembled in the footwear.
Figure 4:
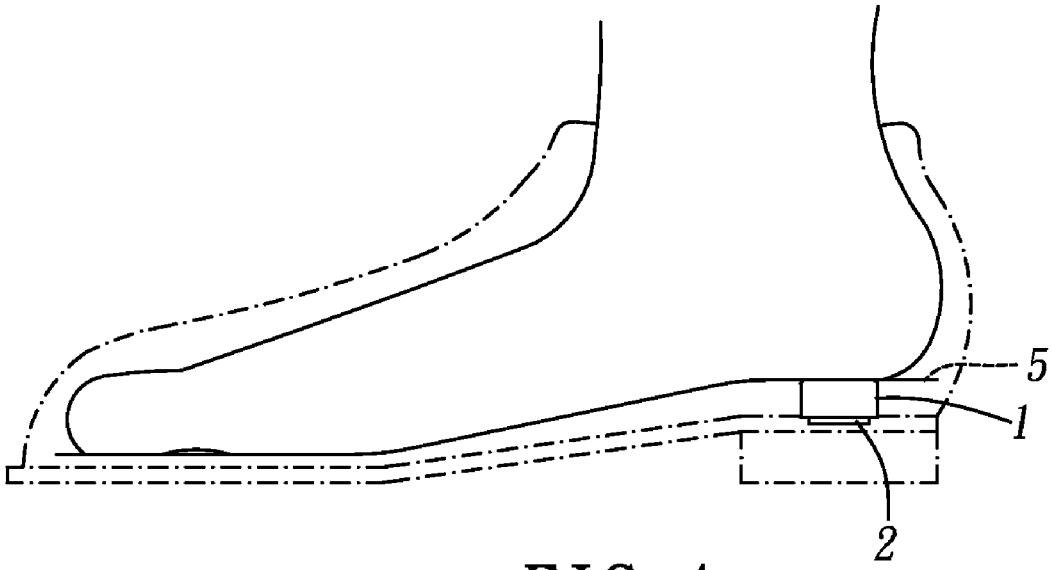
FIGS. 4-5 are operational views of the heater for footwear in accordance with the present invention.
Figure 5:
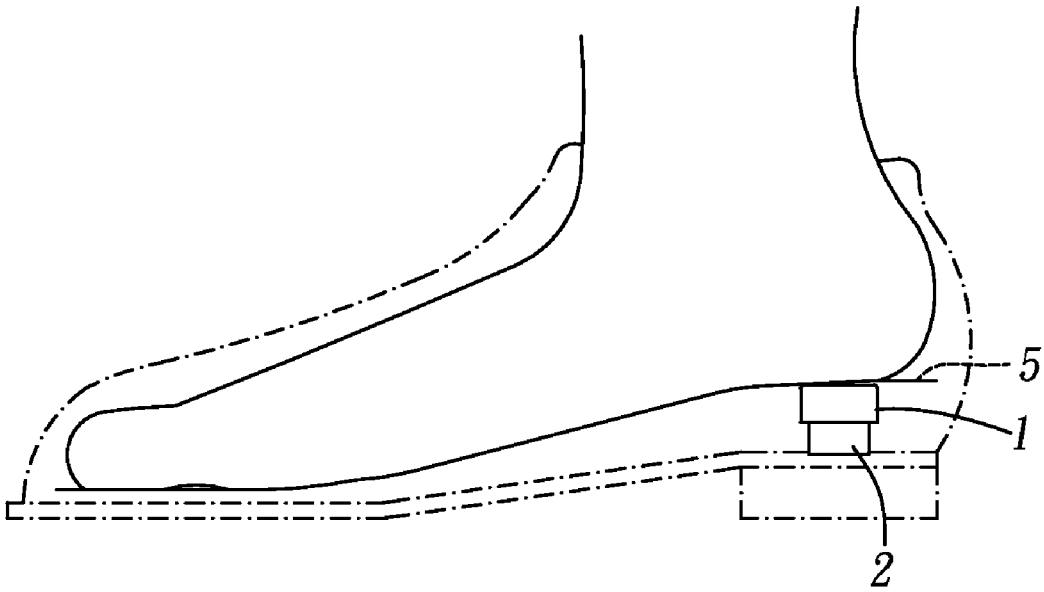
Figure 6:
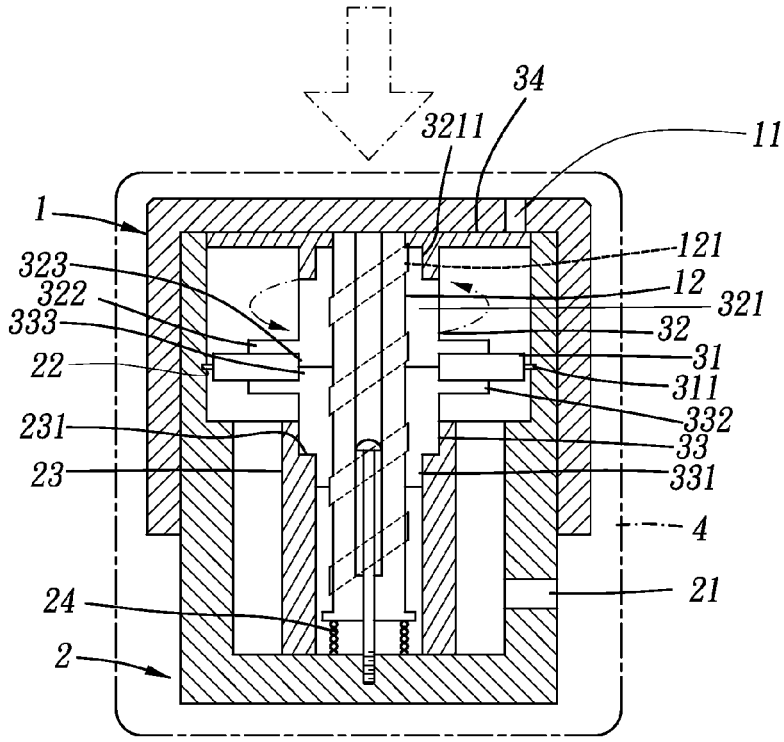
FIGS. 6-7 are operational side plan views of the heater for footwear in accordance with the present invention.
Figure 7:
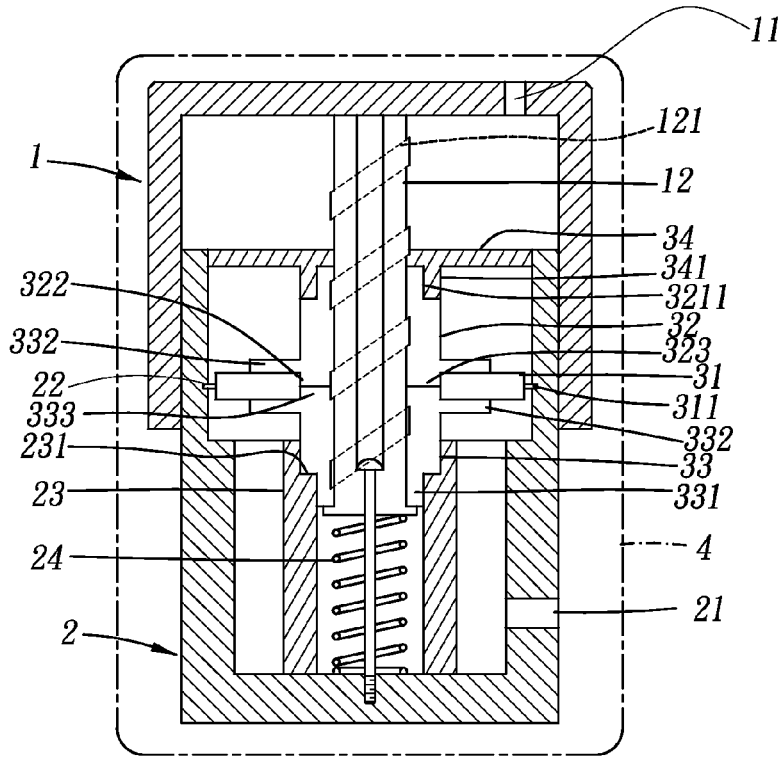

Referring to the drawings and initially to FIGS. 1-3, a heater for footwear in accordance with the present invention comprises a seat 2, a friction mechanism 3 received in the seat 2, and a cap 1 sleeved on the seat 2.

The seat 2 is in form of a cylinder having a space 23 centrally defined therein. The seat 2 has a shoulder 231 radially formed on an inner periphery thereof. A spring 24 is compressively received in the space 23 in the seat 2. The seat 2 has an air hole 21 defined in an inner periphery thereof and extending therethrough. The seat 2 has multiple slots 22 respectively defined in the inner periphery thereof and being adjacent to an opening (not numbered) thereof.

The friction mechanism 3 includes a disk 31, an upper rotor 32 rotatably and concentrically mounted on a top of the disk 31, a ring 34 concentrically mounted on a top of the upper rotor 32 for pressing the upper rotor 32, and a lower rotor 33 rotatably and concentrically mounted on a bottom of the disk 31. The disk 31 has a hole 312 centrally defined therein and extending therethrough. The disk 31 has multiple protrusions 311 radially formed on an edge thereof and corresponding to the multiple slots 22 in the seat 2. In the preferred embodiment of the present invention, the disk 31 is formed of metal material. The upper rotor 32 and the lower rotor 33 are generally mirror images of each other. The upper rotor 32 has a threaded hole 3211 defined therein and extending therethrough. The upper rotor 32 has a flange 322 radially extending therefrom to divide the upper rotor 32 into a first part 321 and a second part 323. The first part 321 of the upper rotor 32 has a shoulder (not numbered) formed on an outer periphery thereof. The second part 323 of the upper rotor 32 is received in the hole 312 in the disk 31. The ring 34 is sleeved on the first part 321 of the upper rotor 32. The ring 34 has a skirt 341 longitudinally extending from a bottom thereof and surrounding a hole (not numbered) of the ring 34 for corresponding to the shoulder of the upper rotor 32. The lower rotor 33 has a threaded hole 3311 defined therein and extending therethrough. The lower rotor 33 has a flange 332 radially extending therefrom to divide the lower rotor 33 into a first part 331 and a second part 333. The second part 333 of the lower rotor 33 is received in the hole 312 in the disk 31. The first part 331 of the lower rotor 33 has a shoulder (not numbered) formed on an outer periphery thereof for corresponding to the shoulder 231 of the seat 2.

The cap 1 has a driving unit 12 centrally and longitudinally extending from a bottom thereof. In the preferred embodiment of the present invention, the driving unit 12 is a screw. The driving unit 12 has thread 121 formed on an outer periphery thereof. The cap 1 has an air hole 11 defined therein and extending therethrough.

When assembling, the first part 331 of the lower rotor 33 is rotatably received in the space 23 and the second part 333 of the lower rotor 33 is rotatably received in the hole 312 of the disk 31. Each protrusion 311 of the disk 31 is received in a corresponding slot 22 such that the disk 31 is fixed in the seat 2. The ring 34 is sleeved on the shoulder of the first part 321 of the upper rotor 32 and the second part 323 of the upper rotor 32 is rotatably received in the hole 312 of the disk 31. The cap 1 is sleeved on the seat 2. The driving unit 12 of the cap 1 is abutted against the spring 24 received in the seat 2 via the ring 34, the upper rotor 32, the disk 31, and the lower rotor 33. The thread 121 of the driving unit 12 is engaged with the threaded hole 3211 in the upper rotor 32 and the threaded hole 3311 in the lower rotor 33. The heater in accordance with the present invention is further covered by foam 4 for adapting to be mounted in an insole 5 in the footwear.

Referring to FIGS. 4-7, the operations of the heater in accordance with the present invention are illustrated. When the cap 1 is pressed by a foot, the driving unit 12 is downwardly moved relative to the seat 5 to compress the spring 24. The upper rotor 32 and the lower rotor 33 are respectively rotated relative to the disk 31 due to the upper rotor 32 and the lower rotor 33 are respectively engaged by the driving unit 12.

When the cap 1 is released, the spring 24 is released to push the driving unit 12 upward relative to the seat 2. The upper rotor 32 and the lower rotor 33 are respectively rotated relative to the disk 31 due to the upper rotor 32 and the lower rotor 33 respectively engaged by the driving unit 12. After continuously pressing and releasing the cap 1, heat is created by frictions due to the upper rotor 32 and the lower rotor 33 respectively, continuously, and clockwise/counterclockwise rubbing the disk 31. Therefore, the heat is transmitted to the footwear via the air hole 11, 21 such that the whole footwear is warmed up.

Figure 8:
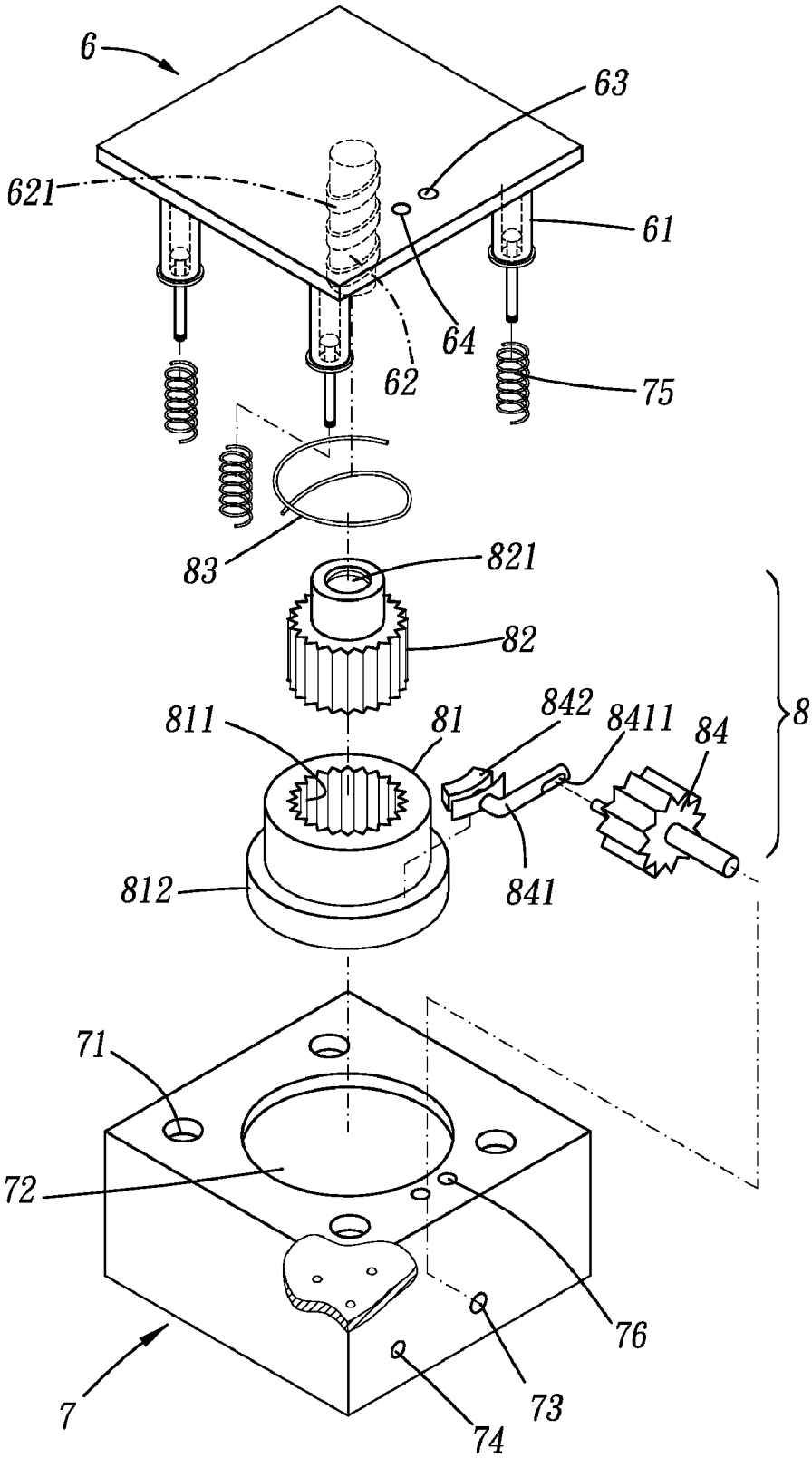
FIG. 8 is an exploded perspective view of the heater for footwear of a second embodiment in accordance with the present invention.
Figure 9:
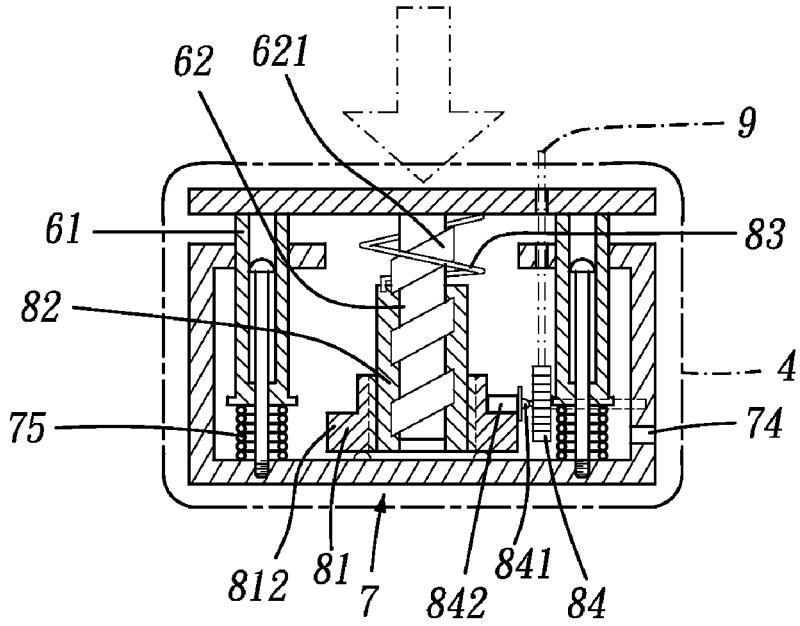
FIGS. 9-10 are operational side plan views of the heater for footwear of the second embodiment in accordance with the present invention.
Figure 10:
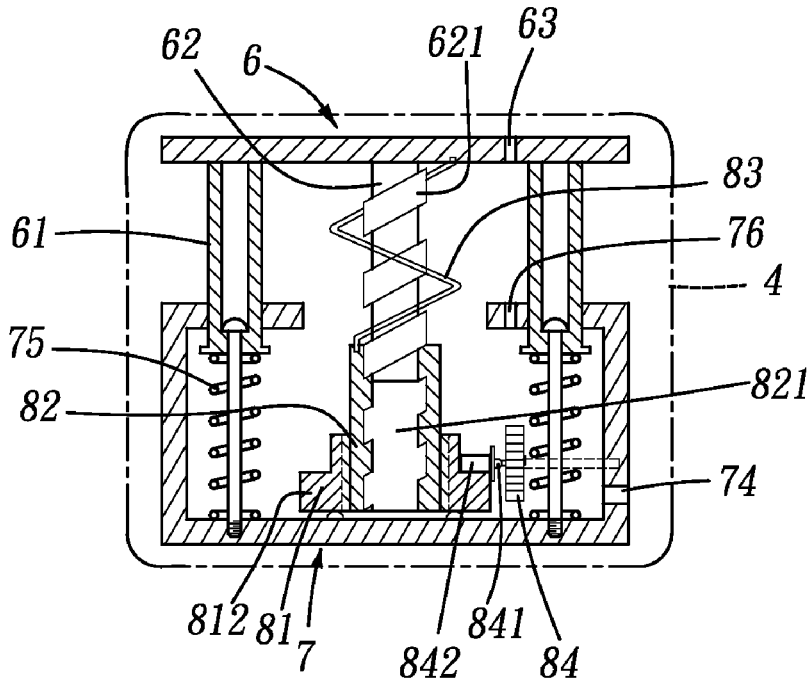

With reference to FIGS. 8-10, that shows a second embodiment of the heater in accordance with the present invention. The elements and effects of the second embodiment which are the same with the first embodiment are not described, only the differences are described. The second embodiment of the heater in accordance with the present invention comprises a seat 7, a friction mechanism 8 received in the seat 7, and a cap 6 mounted on the seat 7.

The seat 7 is in form of a hollow box and has a space 72 defined therein. The seat 7 has multiple position holes 71 respectively defined in corners of a top thereof and communicating with the space 72. The seat 7 has at least one adjusting hole 76 defined thereon and communicating with the space 72. The seat 7 has a pivot hole 73 defined in a side thereof. The seat 7 further has an air hole 74 defined therein and extending therethrough.

The friction mechanism 8 includes an internal gear 81, an external gear 82 mounted in the internal gear 81, a pad 842 laterally abutted against the internal gear, and a pinion 84 connected to the pad 842. The internal gear 81 has teeth 811 formed on an inner periphery thereof and a flange 812 radially formed on an outer periphery thereof. The external gear 82 has a threaded hole 821 defined therein. The external gear 82 is partially received in the internal gear 81 and engaged with the teeth 811 of the internal gear 81. A spring 83 is mounted on the external gear 82. The pad 842 is laterally abutted against the outer periphery of the internal gear 81 and situated near the flange 812 of the internal gear 81. The pad 842 is contacted with the outer periphery and the flange 812 of the internal gear 81. In the preferred embodiment of the present invention, the pad 842 is formed of metal material. The pad 842 has an arm 841 extending therefrom. The arm 841 has a slot 8411 laterally defined therein for connecting to the pinion 84. The pinion 84 has one end laterally partially received in the slot 8411 in the arm 841 and the other end laterally partially received in the pivot hole 73 in the seat 7.

The cap 6 has multiple shanks 61 respectively disposed on the corners of a bottom thereof and extending from the bottom thereof for corresponding to the multiple position hole 71 in the seat 7. Each shank 61 has a spring 75 mounted thereon to provide a bounce effect for the cap 6. The cap 6 has a driving unit 62 extending from the bottom thereof. In the preferred embodiment of the present invention, the driving unit 62 is a screw. The driving unit 62 has thread 621 formed on an outer periphery thereof for corresponding to the thread hole 821 in the external gear 82. The cap 6 further has an adjusting hole 63 defined therein and extending therethrough for corresponding to the adjusting hole 76 in the seat 7. The cap 6 has an air hole 64 defined therein the extending therethrough.

When assembling, the internal gear 81 is received in the space 72 in the seat 7. The external gear 82 is received in the internal gear 81. The pad 842 is disposed on the flange 812 and abutted against the internal gear 81. One end of the pinion 84 is laterally connected to the arm 841 of the pad 842 and the other end of the pinion 84 is pivotally received in the pivot hole 73 in the seat 7. The cap 6 is mounted on the seat 7 and abutted against the spring 83 mounted on the external gear 82. Each shank 61 of the cap 6 and the spring 75 mounted on the shank 61 are received in a corresponding position hole 71 in the seat 7. The driving unit 62 is moveably received in the external gear 82 and engaged with the thread hole 821 in the external gear 82 via the spring 83 mounted on the external gear 82. The heater of the second embodiment in accordance with the present invention is further covered by the foam 4 for adapting to be mounted in the footwear.

When the cap 6 is pressed, the spring 83 mounted on the external gear 82 and the springs 75 mounted on the multiple shanks 61 are compressed and the driving unit 62 of the cap 6 is downwardly moved relative to the seat 7 as shown in FIG. 9. The external gear 82 is rotated due to the driving unit 62 engaged with the thread hole 821 in the external gear 82 such that the external gear 82 is engaged with the internal gear 81 to rotate the internal gear 81 relative to the pad 842. When the cap 6 is released, the spring 83 mounted on the external gear 82 and the multiple springs 75 mounted on the multiple shanks 61 are released to push the driving unit 62 of the cap 6 upwardly moved relative to the seat 7 as shown in FIG. 10. The external gear 82 is engaged by the driving unit 62 to engage internal gear 81 rotated relative to the pad 842.

In the operations of pressing and releasing the cap 6, heat is created by friction due to the external gear 82 continuously clockwise/counterclockwise rubbed the pad 842 for warming up the footwear. Furthermore, as shown in FIG. 9, a pin 9 is engaged with the pinion 84 via the adjusting hoe 63 in the cap 6 and the adjusting hole 76 in the seat 7 for adjusting an angle which the pad 842 is abutted against the internal gear 81.

Although the invention has been explained in relation to its preferred embodiment, it is to be understood that many other possible modifications and variations can be made without departing from the spirit and scope of the invention as hereinafter claimed.

What is claimed is:

1. A heater for footwear comprising:

a seat having a space centrally defined therein, a spring compressively received in the space in the seat;

a friction mechanism received in the seat, the friction mechanism including:

a disk fixed in the seat, the disk having a hole defined therein and extending therethrough;

an upper rotor rotatably mounted on a top of the disk; and a lower rotor rotatably mounted on a bottom of the disk; and a cap sleeved on the seat, the cap having a driving unit longitudinally extending therefrom, the driving unit extending through the upper rotor, the disk, and the lower rotor for movably abutting against the spring received in the space in the seat;

wherein the heater is adapted to be mounted in the footwear;

when the cap is pressed, the spring is compressed and the driving unit is downwardly moved relative to the seat, the upper rotor and the lower rotor are engaged by the driving unit to be rotated for rubbing the disk; when the cap is released, the spring is released and the driving unit is upwardly moved relative to the seat, the upper rotor and the lower rotor are engaged by the driving unit to be rotated for rubbing the disk; heat is created by frictions due to the upper rotor and the lower rotor respectively continuously rubbing the disk for warming the footwear.

2. The heater for footwear as claimed in claim 1, wherein the driving unit has a thread formed on an outer periphery thereof, the upper rotor having a threaded hole defined therein and extending therethrough for engaging the thread of the driving unit, the lower rotor having a threaded hole defined therein and extending therethrough for engaging the thread of the driving unit.

3. The heater for footwear as claimed in claim 1, wherein the seat has multiple slots respectively defined in an inner periphery thereof; the disk has multiple protrusions radially formed on an edge thereof and corresponding to the multiple slots in the seat.

4. The heater for footwear as claimed in claim 1 further comprising a ring concentrically mounted on a top of the upper rotor for pressing the upper rotor.

5. The heater for footwear as claimed in claim 1, wherein the upper rotor has a flange radially extending therefrom to divide the upper rotor into a first part and a second part, the second part of the upper rotor received in the hole in the disk; the lower rotor has a flange radially extending therefrom to divide the lower rotor into a first part and a second part, the first part of the lower rotor partially received in the space in the seat, the second part of the lower rotor received in the hole in the disk.

6. The heater for footwear as claimed in claim 1, wherein the cap has an air hole defined therein and extending therethrough for transmitting heat to the footwear.

7. The heater for footwear as claimed in claim 1, wherein the seat has an air hole defined therein and extending therethrough for transmitting heat to the footwear.

8. The heater for footwear as claimed in claim 1, wherein the heater is covered by a foam for adapting to be mounted in the footwear.

* * * * *